US005450118A

United States Patent [19]

Sawada et al.

[11] Patent Number: 5,450,118

[45] Date of Patent: Sep. 12, 1995

[54] IMAGE FORMING APPARATUS

[75] Inventors: Koichi Sawada; Hiroyuki Yamamoto, both of Hachioji, Japan

[73] Assignee: Konica Corporation, Tokyo, Japan

[21] Appl. No.: 200,669

[22] Filed: Feb. 23, 1994

[30] Foreign Application Priority Data

Mar. 12, 1993 [JP] Japan ..... 5-051751

[51] Int. Cl.[6] ..... B41J 2/435

[52] U.S. Cl. ..... 347/235; 347/115

[58] Field of Search ..... 346/1.1, 107 R, 76 L, 346/108, 160; 358/296, 300, 302; 347/232, 115

[56] References Cited

U.S. PATENT DOCUMENTS 5,043,745 8/1991 Inoue et al. ..... 346/108

5,260,799 11/1993 Loce et al. ..... 358/300

FOREIGN PATENT DOCUMENTS 62-39974A 2/1987 Japan .

*Primary Examiner*—Mark J. Reinhart

*Attorney, Agent, or Firm*—Finnegan, Henderson, Farabow, Garrett & Dunner

[57] ABSTRACT

An image forming apparatus has a structure in which a gradation is reproduced when a laser beam, which is pulse-width-modulated corresponding to an image signal, scans the surface of a recording media. The image forming apparatus includes a pulse width modulation circuit having an automatic adjustment function to automatically adjust an input/output characteristics using a calibration signal as a trigger signal. The image forming apparatus further includes a calibration signal generator which generates a calibration signal just before an image formation.

3 Claims, 9 Drawing Sheets

FIG. 5

| CONTROL | | MODE |
|---|---|---|
| A | B | |
| 0 | X | CENTER JUSTIFY |
| 1 | 0 | RIGHT-HAND JUSTIFY |
| 1 | 1 | LEFT-HAND JUSTIFY |

IMAGE FORMING APPARATUS

BACKGROUND OF THE INVENTION

The present invention relates to an image forming apparatus, and more particularly to an automatic adjustment control of a pulse width modulation circuit for modulating a laser beam corresponding to an image signal.

Conventionally, an image forming apparatus has been widely known in which a laser beam is modulated corresponding to an image signal, and in which the modulated laser beam scans the surface of a recording medium so that gradation can be reproduced (refer to Japanese Patent Publication Open to Public Inspection No. 39974/1987).

The pulse width modulation is conducted as follows: for example, a digital image signal is converted to an analog signal (DC voltage signal); the converted analog signal is compared to, for example, a pattern signal as shown in FIG. 8; and a pulse width modulation signal SPWM having a pulse width corresponding to an image signal can be obtained.

A packaged IC having the a pulse width modulation circuit in one package is currently produced, and some of the pulse width modulation ICs have an automatic adjustment function. The automatic adjustment function is performed as follows: a calibration signal, inputted from the outside of the apparatus, is used as a trigger signal; and in a full scale range of the pulse width modulation signal SPWM, a reference voltage for generating a pattern signal, a reference voltage of a D/A converter, and the like are automatically set.

Here, because input-output characteristics of the pulse width modulation IC vary mainly due to temperature differences, generally, the calibration signal is generated by the structure shown in FIG. 9.

A pulse width modulation IC 51 shown in FIG. 9 is operated as follows: a dot clock DCK and an 8 bit image data DATA are sent to the IC; one of three pulse width modulation modes of the IC is selected by control signals A and B (refer to FIG. 5); and the IC outputs a pulse width modulation signal PWMOUT according to the selected pulse width modulation mode.

In this situation, a temperature sensor 52 for detecting the temperature of the pulse width modulation IC51 is provided; and a voltage outputted from the temperature sensor 52 corresponding to a temperature is converted by an A/D converter 53, and outputted to a CPU 54.

In the CPU 54, the following operations are conducted: a temperature variation is found when current temperature data is compared to the temperature data at the time of the previous calibration; then, in the case where the temperature variation is more than an absolute value of, for example, ±10° C., when a page area signal indicating an image formation area is low, and no image data DATA exists, then a temperature variation detection signal showing the temperature variation is outputted to a calibration signal generator 55.

On the other hand, under the condition that the page area signal is high and the image data DATA exists, the temperature variation detection signal is outputted to the calibration signal generator 55 after processing of the image data DATA has been completed, that is, after the page area signal has been changed to low.

In the calibration signal generator 55, when the temperature variation detection signal is inputted, a calibration signal is generated, and the signal is outputted to a pulse width modulation IC 51. Then, in the pulse width modulation IC 51 when the calibration signal is inputted to the IC 51, an initializing operation is conducted and a full scale range of the pulse width modulation is set.

In this connection, when the calibration signal is generated by the aforementioned circuit composition, the following problems occur: a temperature sensor and an A/D converter are necessary, resulting in a complex circuit composition; and it is necessary to calculate a judgement data in order to judge the temperature variation, and thereby, the calculation load of the CPU is increased.

Further, when the temperature of the pulse width modulation IC is not accurately detected, the automatic adjustment function is inaccurately operated. Accordingly, a highly accurate and expensive temperature sensor is necessary. Another problem is that this composition can not flexibly meet other requirements for automatic adjustment which occur from conditions other than the temperature variation.

SUMMARY OF THE INVENTION

The object of the present invention is to generate the calibration signal by a simple composition, and to effectively operate the automatic adjustment function so that a stable and high quality image can be formed.

For the aforementioned purpose, in the image forming apparatus in which a gradation is reproduced when a laser beam, which is pulse-width-modulated corresponding to an image signal, scans the surface of the recording medium and which comprises a pulse width modulation circuit having an automatic adjustment function to automatically adjust an input/output characteristic using a calibration signal as a trigger signal, the apparatus comprises a calibration signal generator which generates the calibration signal just before the image formation.

Due to the aforementioned composition, the calibration signal is generated just before the image forming operation, and the input/output characteristic of the pulse width modulation circuit is automatically adjusted at every individual image formation.

That is, the automatic adjustment function is operated before each image formation without depending on the detection of the temperature variation. The calibration signal can be generated by a simple circuit composition, and further, the image formation can be carried out under a constantly stable condition by the automatic adjustment before every image formation.

BRIEF DESCRIPTION OF THE DRAWINGS

FIG. 5 is a view showing specific characteristics of pulse width modulation modes.

DETAILED DESCRIPTION OF THE PREFERRED EMBODIMENTS

An example according to the present invention will be described as follows.

Figure 1:
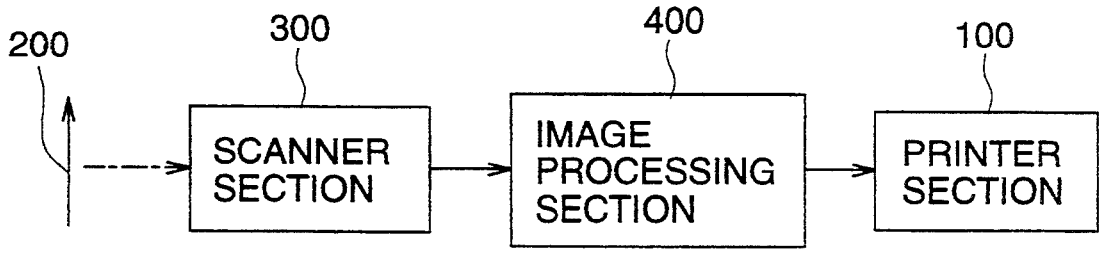
FIG. 1 is a block diagram showing a basic structure of a digital copier of this example.

FIG. 1 is a view showing a basic structure of a digital copier to which an image forming apparatus according to the present invention is applied, and the copier comprises a scanner section 300, an image processing section 400, and printer section (image forming apparatus) 100.

The scanner section 300 optically scans a document 200, and image information of the document 200 is converted into an optical image. The optical image is supplied to an image processing section 400, then, converted into an electric signal, and a predetermined image processing operation is conducted.

In the printer section 100, an image is formed according to a digital image signal (pixel data), which is formed of predetermined bits and formed in the image processing section 400.

Figure 2:
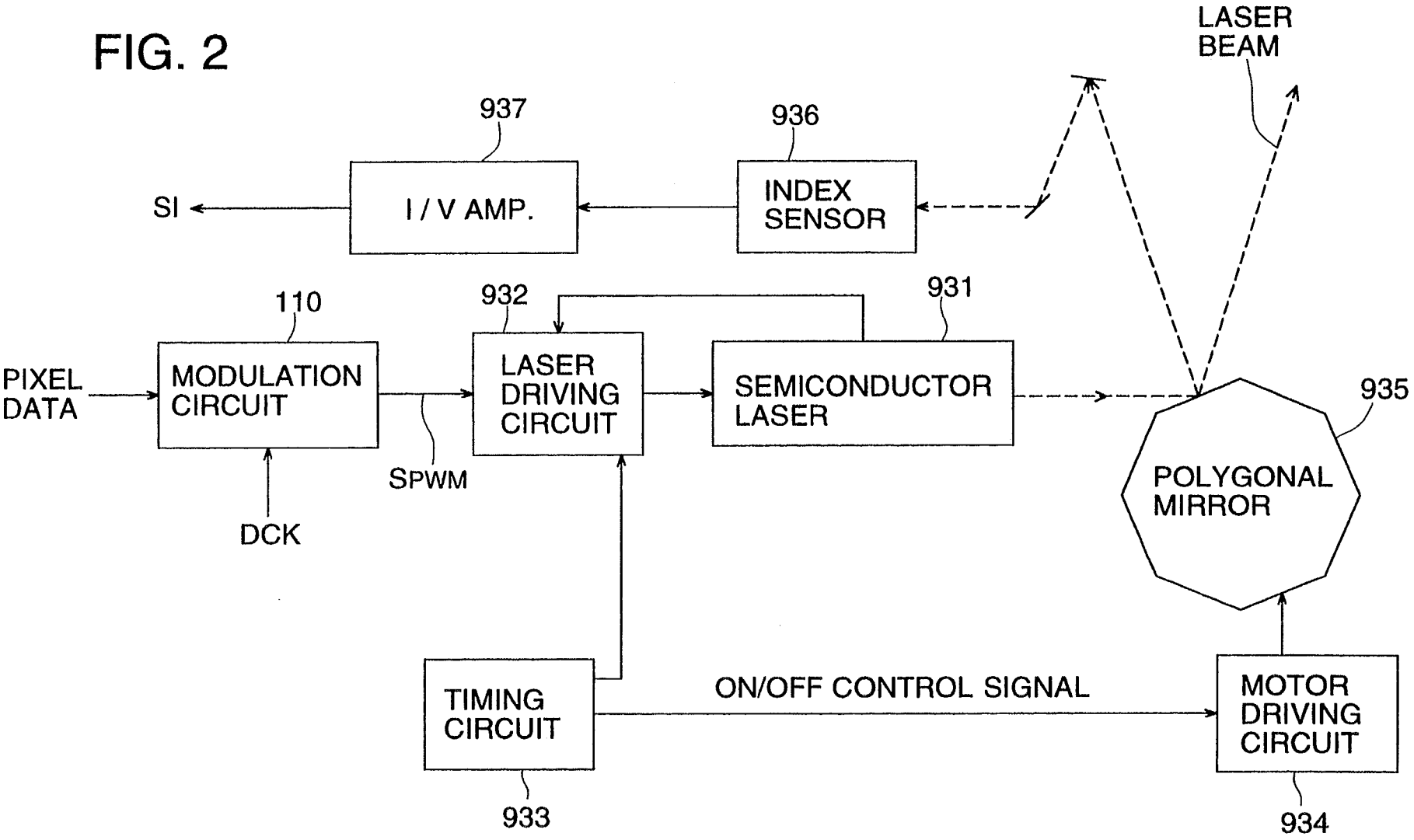
FIG. 2 is a block diagram showing a printer section in the above example.

FIG. 2 shows the printer section (image forming apparatus) 100 comprising an electrophotographic printer using a photoreceptor drum, in which a laser beam is used for a light source by which an electrostatic latent image is formed on the photoreceptor drum.

In FIG. 2, a pixel data DATA outputted from the image processing section 400 is supplied to a pulse width modulation circuit 110, and in this circuit 110, a pulse width modulation signal SPWM is formed according to the pixel data DATA and a dot clock DCK.

The pulse width modulation signal SPWM formed in the pulse width modulation circuit 110 is supplied to a semiconductor laser 931 through a laser drive circuit 932, and the laser beam is modulated by the pulse width modulation signal SPWM. The laser drive circuit 932 is controlled by a control signal outputted from a timing circuit 933 so that the drive circuit is under the driving condition only within horizontal and vertical effective ranges.

A signal showing an amount of light of the laser beam is fed back from the semiconductor laser 931 to the laser drive circuit 932, and the drive of the semiconductor laser 931 is controlled so that its amount of light becomes constant. The laser beam outputted from the semiconductor laser 931 is supplied to a polygonal mirror 935 and reflected. A scanning starting point of the laser beam reflected by the polygonal mirror 935 is detected by an index sensor 936, the detected signal is converted into a voltage signal by a current/voltage conversion amplifier 937, and an index signal SI is formed. The index signal SI is supplied to a control means for controlling the optical scanning timing of the scanner section.

Numeral 934 is a drive circuit of a motor which rotates a polygonal mirror 935, for which an on/off signal is supplied from the timing circuit 933.

Figure 3:
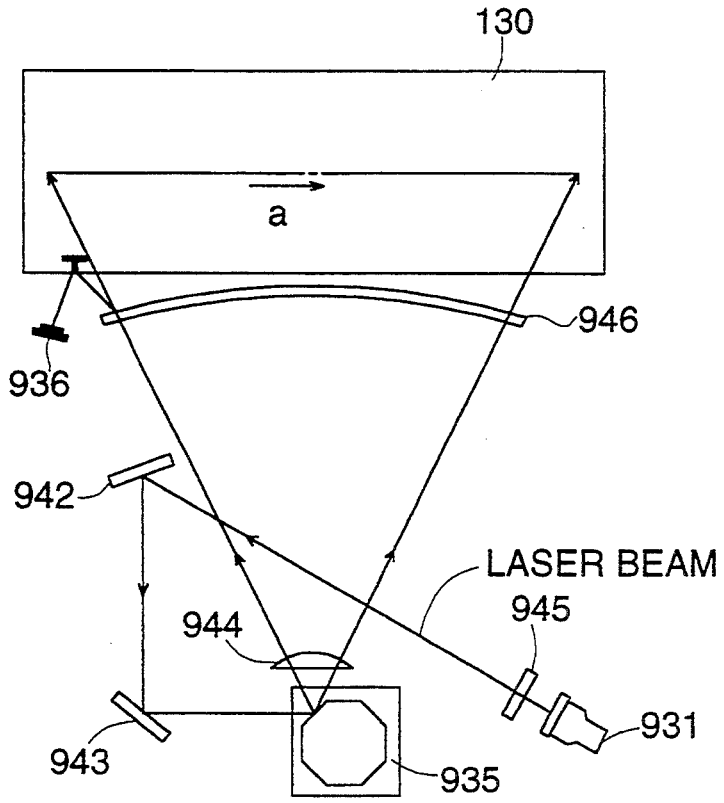
FIG. 3 is a view showing a laser exposure system in the above example.

FIG. 3 is an example of an image exposure system in which an image is formed by the laser beam.

The laser beam emitted from the semiconductor laser 931 enters the polygonal mirror 935 through mirrors 942 and 943. The laser beam is reflected by the polygonal mirror 935, and irradiated on the surface of the photoreceptor drum 130 through an f$\theta$ lens 944 for image formation by which the diameter of the laser beam is adjusted to a predetermined value.

Numerals 945 and 946 are cylindrical lenses for tilt angle correction.

Here, the laser beam scans the surface of the photoreceptor drum in a predetermined direction "a" at a constant speed using the polygonal mirror 935. Due to the foregoing, the exposure is made corresponding to pixel data (reproduction of gradation), and a electrostatic latent image is formed on the photoreceptor drum 130.

Then, toner, which is charged at opposite polarity of the latent image, adheres to the latent image, and development is conducted. A recording sheet is superimposed on the toner image, an electric charge in reverse polarity to the toner image is given to the recording sheet from the reverse side of the recording sheet by a corona charger, and the toner image is transferred onto the recording sheet. Further, the transferred toner image is heated or pressurized, and fixed on the recording sheet.

Figure 4:
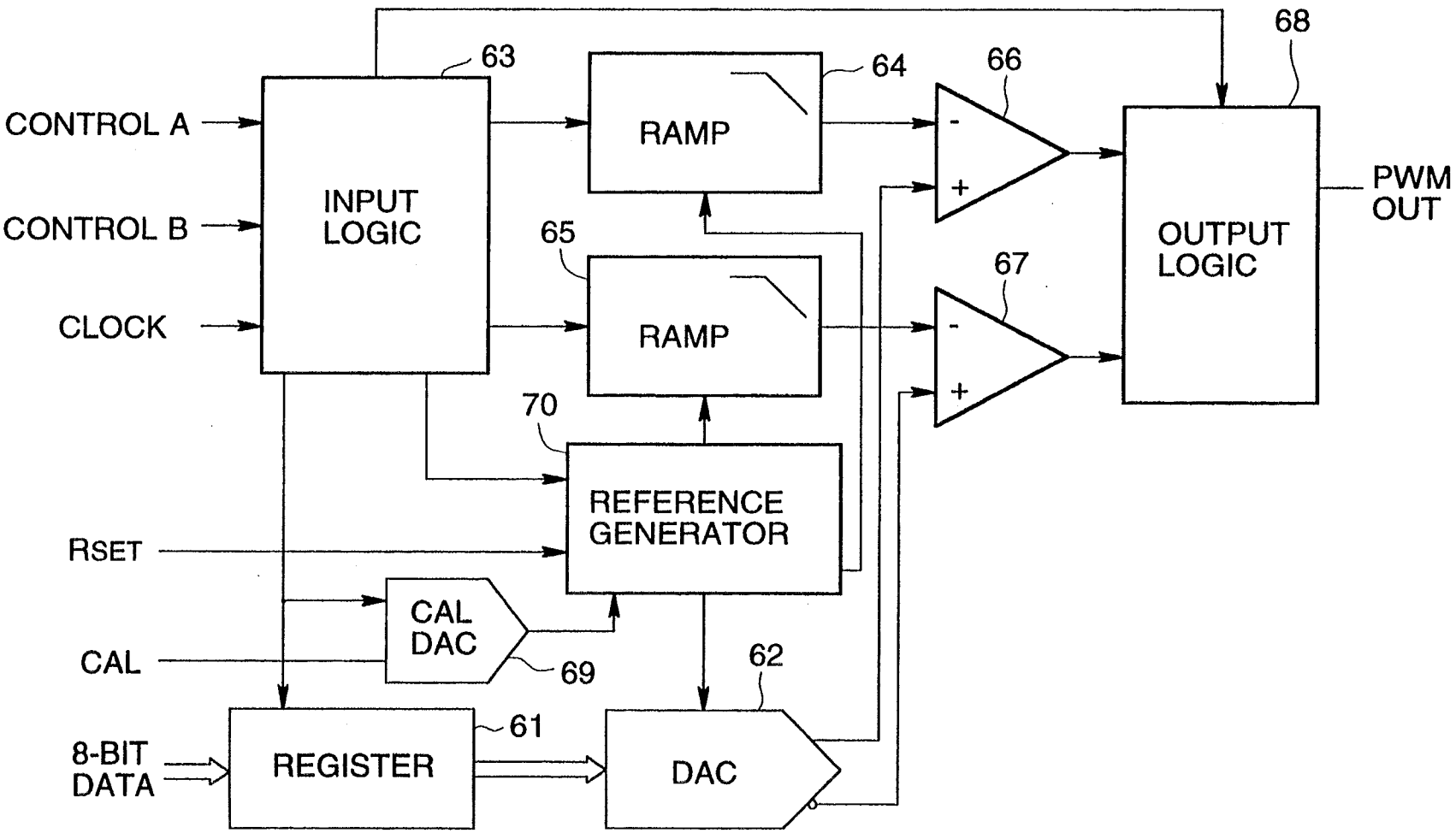
FIG. 4 is a block diagram showing a pulse width modulation circuit in the above example.

In this example, for the aforementioned pulse width modulation circuit 110, a circuit for conducting pulse width modulation is accommodated in one package and formed into an IC, the composition of which is shown in FIG. 4.

In FIG. 4, the 8 bit image data DATA is temporarily stored in a register 61, and then, converted into an analog signal (DC voltage signal) by a D/A converter 62.

A dot clock CLOCK, and control signals A and B which specify a pulse width modulation mode are inputted into an input logic circuit 63. In ramp wave generation circuits 64, 65, into which an output from the input logic circuit 63 is inputted, ramp waves corresponding to two outputs from the D/A converter 62 are respectively generated based on the dot clock CLOCK according to the modulation mode specified by control signals A and B.

In comparators 66, 67, the ramp waves are respectively compared to the analog signals outputted from the D/A converter 62, and the result of the comparison is outputted through an output logic circuit 68 as a pulse width modulation signal PWMOUT.

As the modulation mode, three kinds of modes, for example, a mode in which the pulse width is spread from a center position of a pixel (center justify mode), a mode in which the pulse width is spread from the left end of the pixel (left-hand justify mode), and a mode in which the pulse width is spread from the right end of the pixel (right-hand justify mode), are previously set, and one of the three kinds of modes is specified by the combination of control signals A and B (refer to FIG. 5).

The pulse width modulation IC of this example is provided with a function by which the input/output characteristic is automatically adjusted using the calibration signal CAL from outside the apparatus as a trigger signal.

Specifically, when the calibration signal is inputted from outside the apparatus, a D/A converter for the calibration 69, into which a clock pulse is inputted from the input logic circuit 63, is operated and outputs, for example, a signal having a level corresponding to a time period of the dot clock to a reference voltage generator 70.

In the reference voltage generator 70, the reference voltage of the ramp wave generation circuits 64, 65 and the reference voltage of the D/A converter 62 are set corresponding to the output of the D/A converter for calibration 69, a full scale for the pulse width modulation is set, and the input/output characteristic is automatically adjusted.

Figure 6:
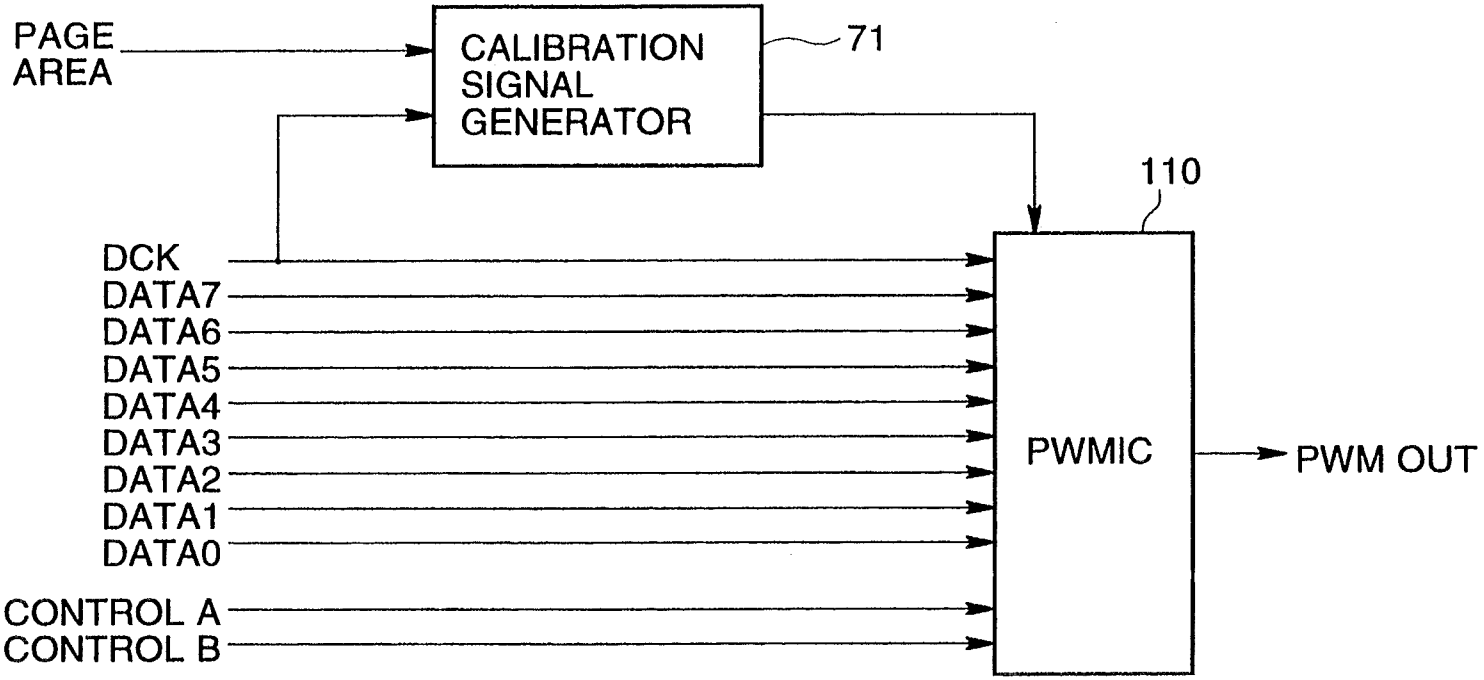
FIG. 6 is a view showing a calibration signal generator in the above-mentioned example.
Figure 7:
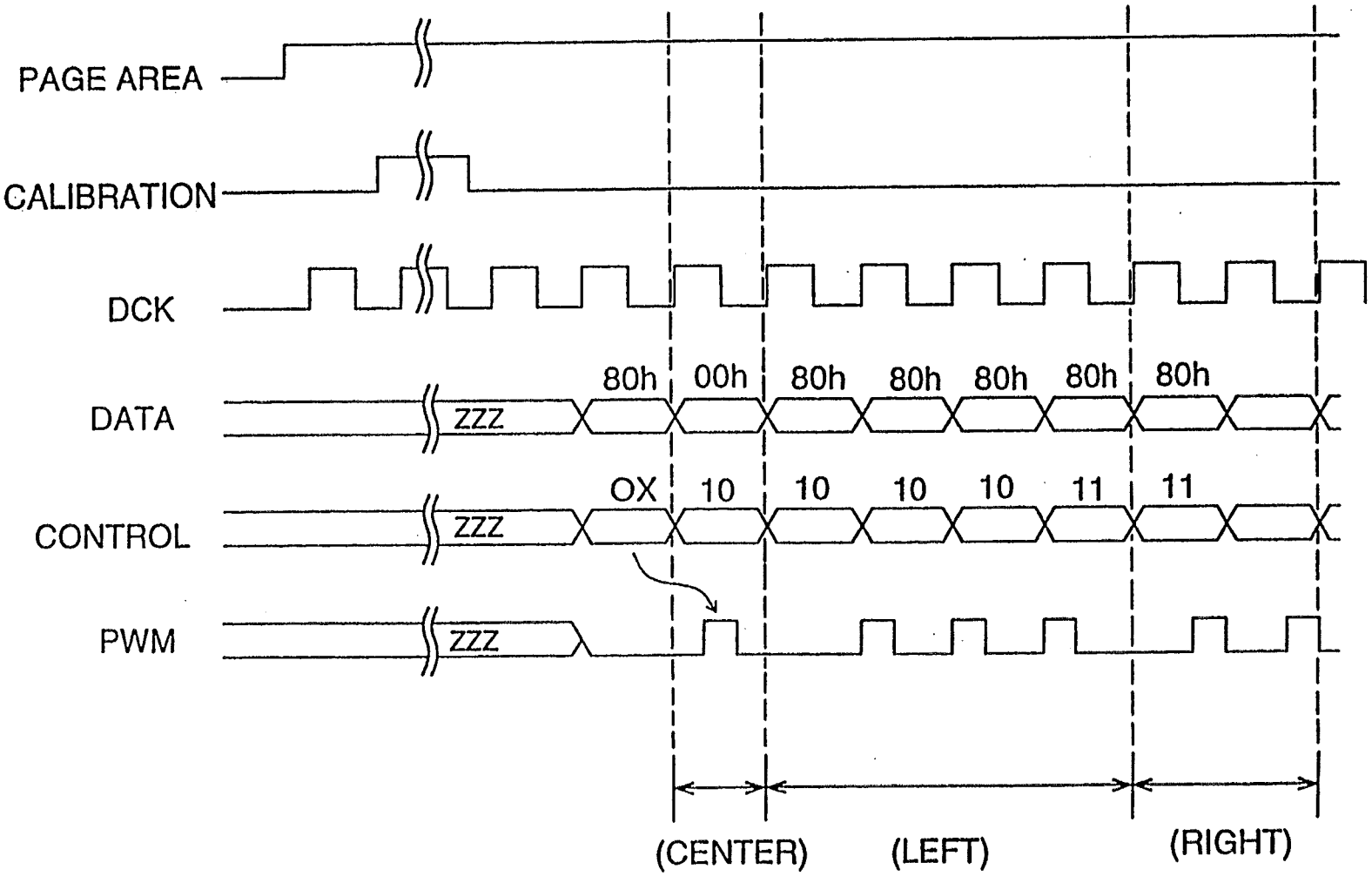
FIG. 7 is a time chart showing timing when the calibration signal is generated in the above-mentioned example.
Figure 8:
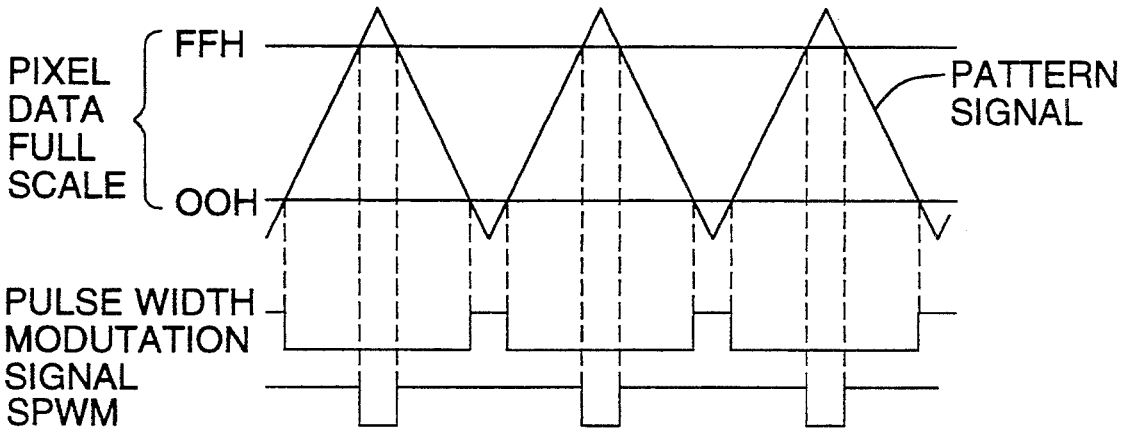
FIG. 8 is a time chart showing an example of the pulse width modulation.
Figure 9:
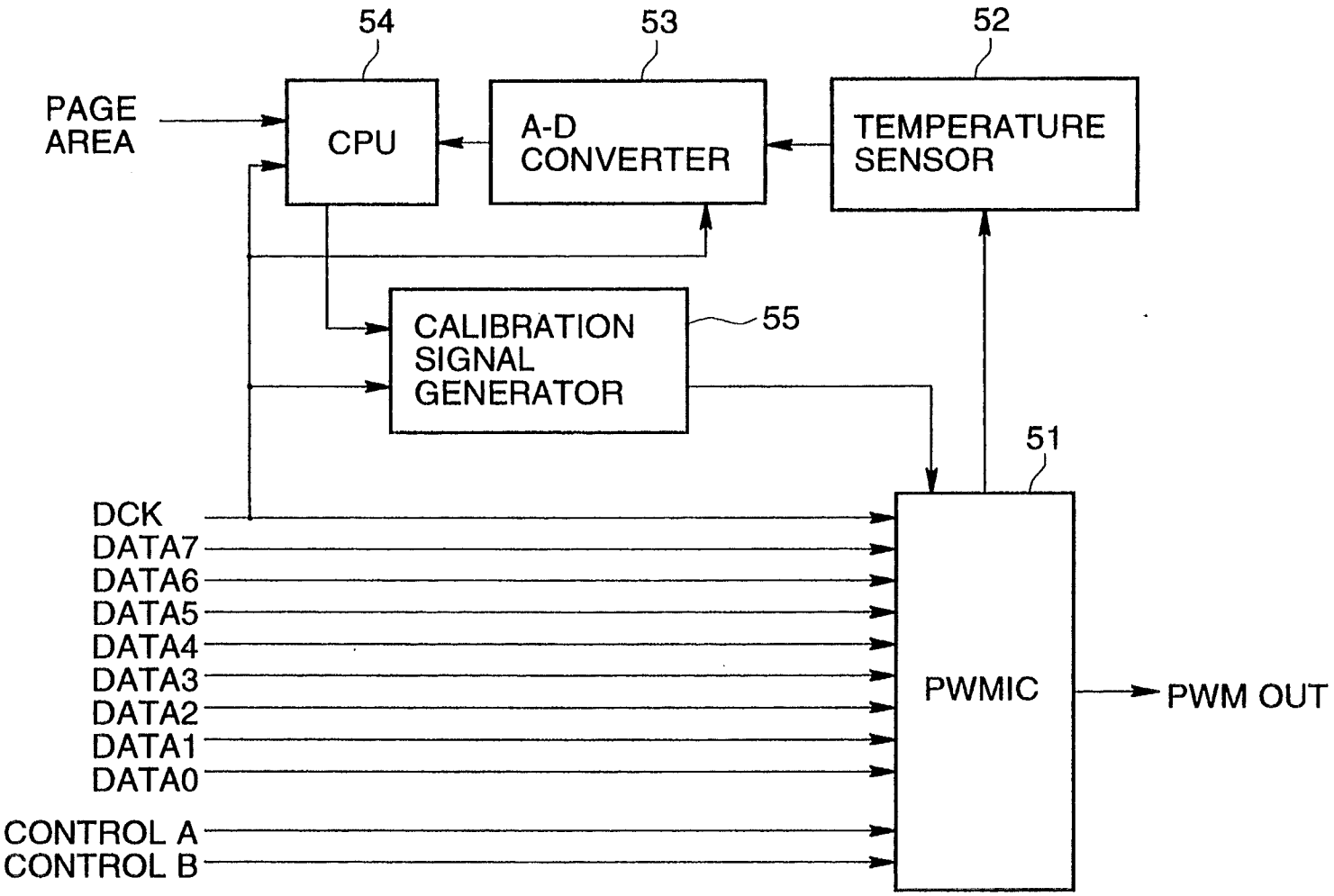
FIG. 9 is a view showing a conventional calibration signal generator.

Here, the calibration signal is formed by the circuit composition shown in FIG. 6 in the timing sequence shown in the time chart in FIG. 7.

That is, the dot clock DCK and a page area signal indicating an image formation area are inputted into a calibration signal generator 71. When the page area signal rises, the calibration signal is formed in a period of time between the rise of the page area signal and the input of the pixel data DATA, and the calibration signal is outputted to the pulse width modulation IC (D/A converter 69).

Accordingly, the calibration signal is generated for each page just before the image formation, and the full scale is set (automatic adjustment) in the pulse width modulation IC. Accordingly, the calibration signal can be generated by a simple electrical composition, and the image can be formed under constant stable conditions when an automatic adjustment function is operated for each image formation.

That is, the aforementioned automatic adjustment is necessary if there is temperature variation. However, when the automatic adjustment function is operated for each image formation, the automatic adjustment is conducted irrespective of the temperature variation. Accordingly, requests for automatic adjustment due to not only the temperature variation but also other environmental conditions are satisfied, and a high quality image can be reliably formed.

Further, this apparatus is structured in the manner that the calibration signal is generated just before image formation according to the page area signal, and thereby, the circuit composition can be made simpler when compared to the case where a temperature sensor, or the like, is used for generating a calibration signal.

Further, the circuit composition in the pulse width modulation IC in which the automatic adjustment is conducted according to the calibration signal, and adjustment methods thereof are not limited to the aforementioned, but a pulse width modulation IC having a function by which the automatic adjustment is conducted using the calibration signal sent from outside the apparatus as a trigger signal, may also be used.

Further, in the above example, the apparatus is structured in such a manner that the calibration signal is generated according to a page area signal which indicates an image formation area, assuming monochromatic recording. However, for example, in a color printer in which toner images of yellow Y, magenta M, cyan C and black Bk are superimposed on each other so that a full color image is formed, it may be structured in the manner that a calibration signal is respectively generated just before each color image is formed. Alternatively, it may be structured in the manner that the calibration signal is generated initially only once for each color image and the automatic adjustment is conducted, and finally, the image formation is respectively conducted for each color.

As described above, due to the image forming apparatus according to the present invention, a calibration signal, which is used as a trigger signal for an automatic adjustment function of a pulse width modulation circuit, is generated just before image formation, and therefore, a circuit composition for generating the calibration signal can be simplified. At the same time, it is advantageous that, when the automatic adjustment is conducted for each image formation, an image can be formed under constant stable conditions even when various variations occur, other than temperature variations.

What is claimed is:

1. An apparatus for forming an image on a recording media, comprising:

means for generating a laser beam modulated in accordance with an image signal and for scanning the recording media with the laser beam to reproduce gradation;

calibration signal circuit means for generating a calibration signal according to a page area signal indicating an image formation area, the calibration signal being generated immediately before image formation of an image area on the recording media for a page; and modulating circuit means for modulating pulse width of the laser beam according to input and output characteristics of said modulating circuit automatically adjusted at each image formation by using the calibration signal as a trigger.

2. The image forming apparatus of claim 1, wherein the image includes color images and wherein said calibration signal circuit means generates a calibration signal immediately before each color image is formed.

3. The image forming apparatus of claim 2, wherein the calibration signal is generated and the adjustment of input and output characteristics of said modulating circuit means is conducted initially only once for each color image, and then each color image is respectively formed.

* * * * *